United States Patent [19]

Teach

[11] 4,050,171

[45] Sept. 27, 1977

[54] DEPTH CONTROL FOR ENDLESS CHAIN TYPE TRENCHER

[75] Inventor: Ted L. Teach, Dayton, Ohio

[73] Assignee: Laserplane Corporation, Dayton, Ohio

[21] Appl. No.: 685,528

[22] Filed: May 12, 1976

[51] Int. Cl.[2] ..... E02F 5/06

[52] U.S. Cl. ..... 37/86; 37/DIG. 1; 37/DIG. 19

[58] Field of Search ..... 37/DIG. 19, DIG. 20, 37/DIG. 1, 86, 90; 172/4, 4.5, 430

[56] References Cited

U.S. PATENT DOCUMENTS

| | | | |
|---|---|---|---|
| 915,963 | 3/1909 | Hovland | 37/DIG. 19 |
| 1,194,460 | 8/1916 | Yocum | 37/DIG. 19 |
| 1,239,474 | 9/1917 | French | 37/86 |
| 1,661,812 | 3/1928 | Smith | 37/DIG. 19 |
| 2,580,954 | 1/1952 | Przybylski | 37/DIG. 19 |
| 3,044,194 | 7/1962 | Balkheimer | 37/86 |
| 3,376,574 | 4/1968 | Gosling | 172/4.5 X |
| 3,708,232 | 1/1973 | Walsh | 37/DIG. 19 |
| 3,813,171 | 5/1974 | Teach et al. | 172/4.5 X |
| 3,887,012 | 6/1975 | Scholl et al. | 172/4.5 |

FOREIGN PATENT DOCUMENTS

| | | | |
|---|---|---|---|
| 1,944,998 | 3/1971 | Germany | 37/DIG. 1 |
| 1,708,582 | 2/1976 | Germany | 37/DIG. 19 |
| 1,209,963 | 1/1966 | Germany | 37/DIG. 19 |
| 1,484,667 | 1/1969 | Germany | 37/DIG. 19 |
| 141,444 | 7/1953 | Sweden | 37/DIG. 19 |

OTHER PUBLICATIONS

Studebaker, "The Laserplane System," Agricultural Engineering, Aug., 1971; pp. 418–419.

*Primary Examiner*—Clifford D. Crowder
*Attorney, Agent, or Firm*—W. A. Schaich

[57] ABSTRACT

The cutting depth of an endless chain type trencher is normally determined by the angle of the frame carrying the endless chain relative to the horizontal. In accordance with this invention, the angular position of the digging frame, hence the depth of the trench is controlled by the angular relationship of a trailing shoe carried by the digging frame relative to the digging frame. The trailing shoe has an elongated horizontal bottom surface that normally rides along the bottom of the formed trench. An upstanding mast is secured to the shoe at a point forwardly of the bottom surface and means on the top of the mast are utilized to indicate and control the depth of the trench.

6 Claims, 3 Drawing Figures

DEPTH CONTROL FOR ENDLESS CHAIN TYPE TRENCHER

BACKGROUND OF THE INVENTION

Endless chain type trenchers heretofore utilized comprised an elongated frame having one end thereof pivotally mounted on a vehicle for movement in a vertical plane parallel to the path of travel of the vehicle. The digging frame provides a mounting for a power-driven endless chain carrying a plurality of spaced digging scoops. Hydraulic cylinders are provided to pivot the frame relative to the vehicle. The depth of the trench to be dug is determined by the angular position of the digging frame with respect to the vehicle. It has been the practice to mount a shoe element to the trailing end of the digging frame which shoe performs two functions. It has an elongated horizontal bottom surface which rides along the bottom of the newly formed trench and provides a support to the free end of the trencher to maintain the digging unit in a constant depth. Variations of the angular position of said shoe relative to the digging frame may be effected by an hydraulic cylinder and thus the effective depth of the trench may be varied. Additionally, the trailing shoe may be provided with an arcuately curved passage having a horizontally disposed opening at the rear end of the shoe and a upwardly disposed opening in the forward portion of the shoe through which an endless flexible pipe or cable may be fed to lie in position in the bottom of the trench.

Where the vehicle is moving over reasonably level ground and the composition of the soil is uniform, the above described arrangement will maintain the depth of the trench being dug at a reasonably consistent level without the application of any controls. The mass of the trencher and trailing shoe in combination is sufficiently great that the trencher tends to remain at the position where the horizontal bottom of the shoe is aligned with and supported by the bottom of the trench and hence, once the desired depth is reached, the power cylinders for pivoting the digging frame relative to the vehicle are generally placed in a hydraulic floating condition so that they do not exert any forces on the digging frame except when it is desired to lift the entire frame out of the trench.

There are trenching applications, however, where a high degree of accuracy of the trench depth must be maintained irrespective of the fact that the surface terrain varies considerably in elevation and the soil conditions are not uniform.

OBJECTS OF THE INVENTION

Accordingly, it is an object of this invention to provide an improved mechanism for controlling the depth of the trench produced by an endless chain type trencher, in particular, it is an object of this invention to provide a trench depth control system responsive to a reference plane defined over the working area of the trencher by a rotating laser beam or by stationary sighting bars.

A specific object of the invention is to provide a pipe-laying shoe for an endless chain type trencher which is trailingly mounted to the bottom end of the trencher frame, pivotally secured thereto for movements in a vertical plane, and to utilize movements of the shoe relative to a horizontal reference plane to indicate changes in trench depth, in particular, to mount a mast on such pivoted trenching shoe at a position forwardly of the bottom surface of the shoe, so that laser beam sensors or a sighting bar carried by the top portion of the mast are moved in a vertical direction opposite to the pivotal movements of the trench shoe relative to the digging frame, thus generating signals or visual indications which may be employed to actuate the power cylinders controlling the angle of the digging frame relative to the vehicle to maintain the digging depth of the trencher frame at a constant regardless of vertical variations in the terrain traversed by the vehicle or consistency of the soil.

Other objects and advantages of the invention will become apparent to those skilled in the art from the following detailed description taken in conjunction with the annexed sheets of drawings.

DESCRIPTION OF INVENTION

Figure 1:
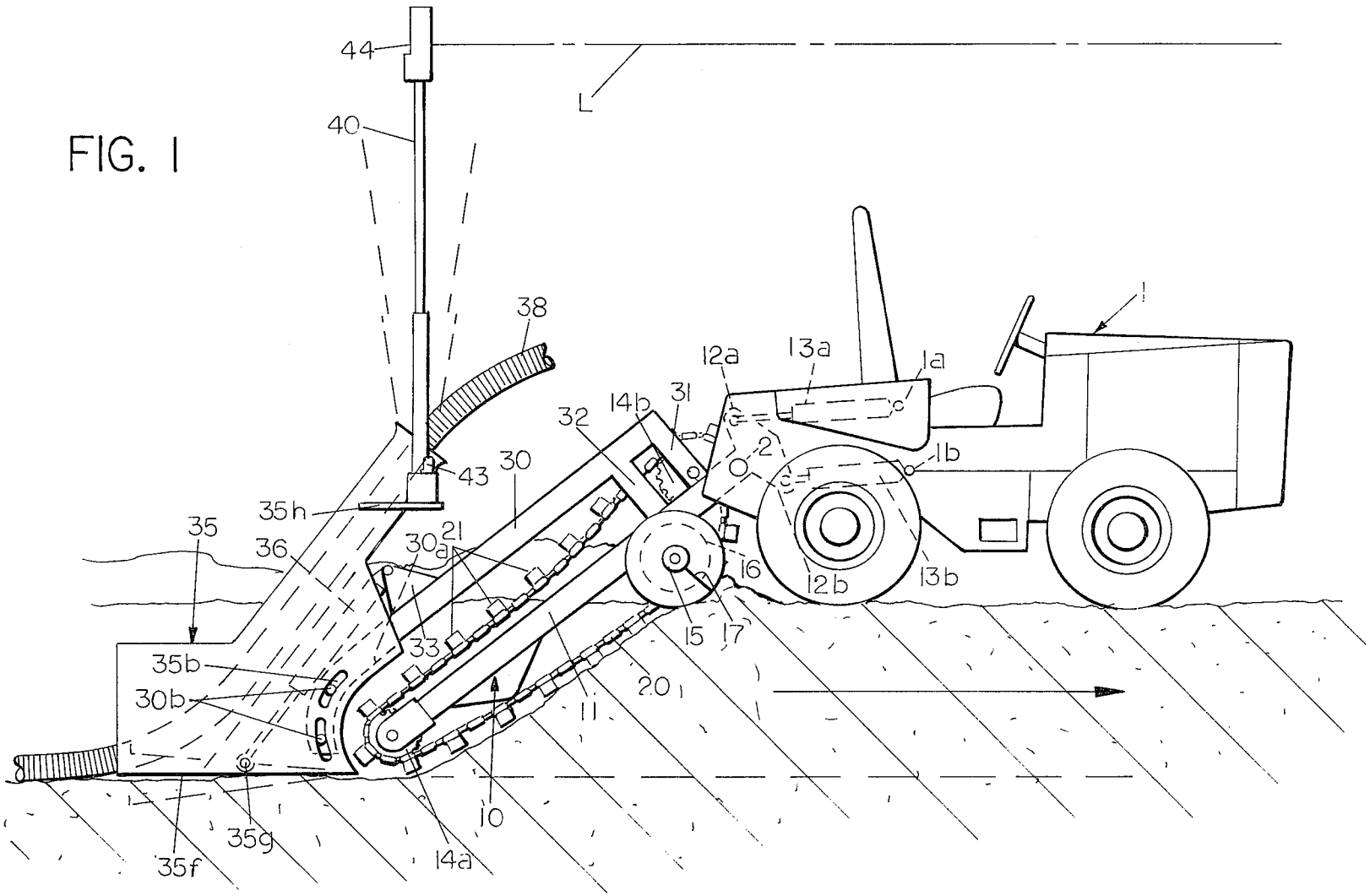
FIG. 1 is a side elevational, schematic view of an endless chain type trencher embodying this invention.
Figure 2:
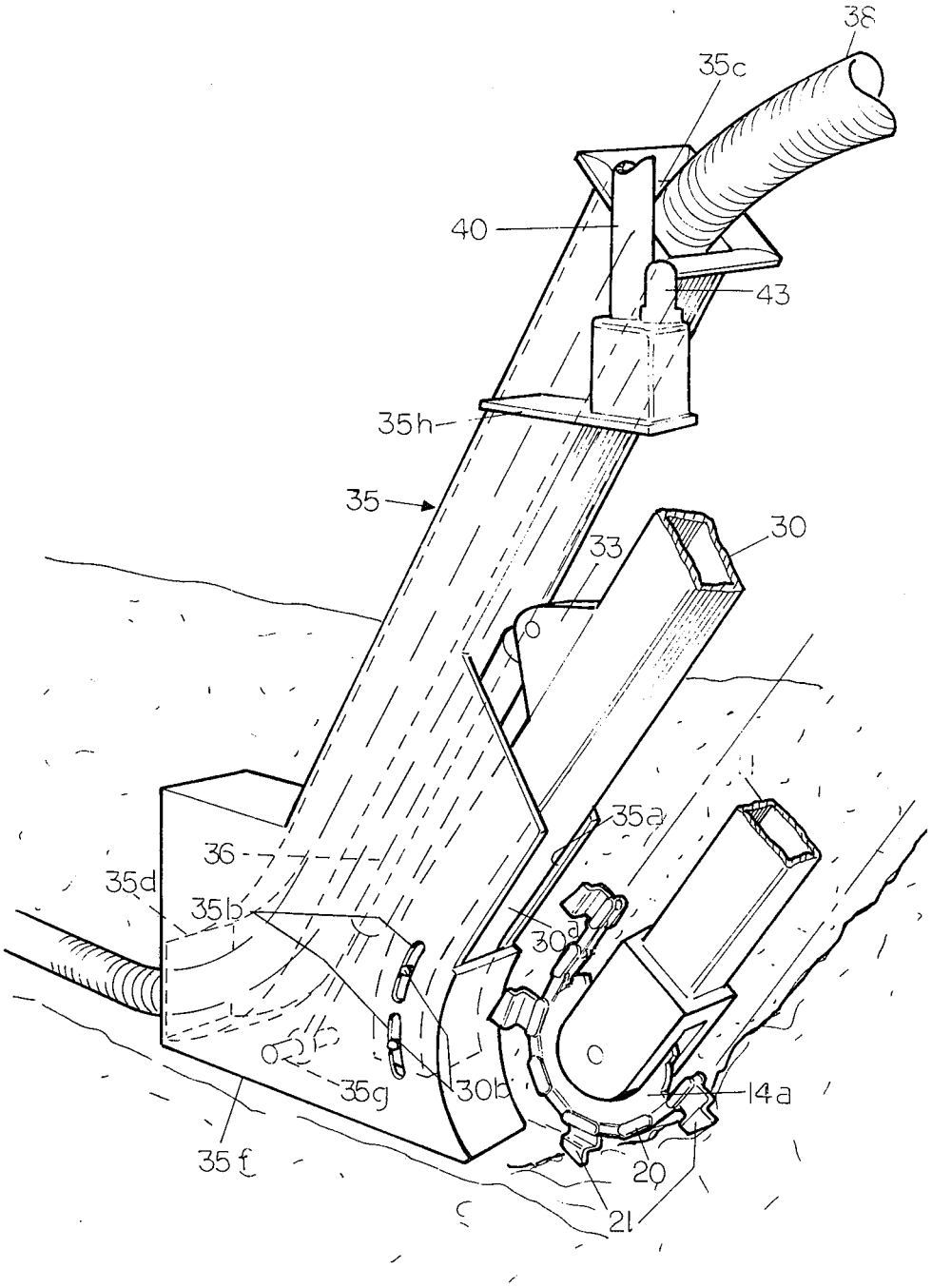
FIG. 2 is a partial perspective view of the trench shoe of FIG. 1.

In FIG. 1 there is schematically shown a tractor-type vehicle 1 having means on the rear portion thereof for pivotally mounting an endless chain type trencher 10. Trencher 10 comprises a digging frame 11 having the forward end thereof secured to a horizontal pivot shaft 2 carried by vehicle 1. A pair of crank arms **12*a* and 2*b* are respectively rigidly secured to frame 11 and the ends thereof are respectively secured to actuating cylinders 13*a* and 13*b* which are respectively pivotally mounted on vehicle 1 on pins 1*a* and 1*b*. Thus, the digging frame 11 may be shifted in a vertical plane about the pivotal mounting shaft 2 from an inoperative position wherein the digging frame 11 is completely above the ground, to a digging position where the rear end of this digging frame 11** is disposed below the ground level.

Suitable chain sprockets **14*a* and 14*b* are provided at each end of the digging frame 11 and sprocket 14*b* at the front end of the digging frame is driven by power means (not shown) on vehicle 1. At an intermediate point on the frame 11, a horizontal shaft 15 is provided which mounts on idler sprocket 16 which is driven by the endless chain 20 which traverses the chain sprockets 14*a* and 14*b*. Chain 20 carries a plurality of digging scoops 21 spaced along its periphery. On both sides of shaft 15, a helical diverter 17 is mounted which moves the dirt carried upwardly by the digging scoops 21 on the endless chain 20** to a position on each side of the resulting trench.

All of the mechanism heretofore described is conventional and, for this reason, is shown only in schematic fashion.

In accordance with this invention, a sub-frame 30 is provided having inverted V-shaped mounting brackets 31 and 32 rigidly secured to the top portions of digging frame 11 and straddling the path of the digging chain 20. Sub-frame 30 projects downwardly and rearwardly, generally parallel to a line drawn between the rotational axes of the chain sprockets **14*a* and 14*b*. The extreme trailing end portion 30*a* of sub-frame 30 is arcuately shaped to define an arc of a circle drawn about the axis of chain sprocket 14*a*. A pipe-laying shoe 35 is provided comprising a hollow welded structure having an arcuate passageway 35a which snugly receives the arcuate end portion 30a of sub-frame 30 so as to permit the shoe 35 to pivotally move on sub-frame 30 about the pivotal axis of the sprocket 14a. Such pivotal movement is limited by a pair of laterally projecting pins 30b which respectively co-operate with arcuate slots 35b formed in the walls of the arcuate passage 35a**.

Additionally, the trench shoe 35 defines a pipe-laying conduit 35c of generally arcuate configuration with the rear end 35d thereof substantially horizontally disposed and the forward end thereof projecting upwardly so as to permit an endless length of flexible pipe or cable 38 to be inserted through the passageway 35c to lie in the bottom of the newly formed trench. Lastly, the trench shoe 35 is provided with an elongated flat bottom surface 35f which normally rides in a horizontal position along the bottom of the newly formed trench.

In prior art constructions pivotal movements of the pipelaying shoe 35 relative to the digging frame 11 are controlled by an hydraulic cylinder 36 which has one end pivotally mounted on an appropriate bracket 33 provided on sub-frame 30 and the other end pivotally secured to a transverse pin 35g provided on the shoe 35.

If cylinder 36 is actuated to shift shoe 35 in a clockwise direction, as viewed in the drawings, the effect will be to raise the entire shoe bottom 35f relative to the bottom of the trench and the entire digging frame will move downwardly until the shoe bottom 35f is again horizontal and supported by the new depth trench bottom.

In accordance with this invention, the cylinder 36 is not a power actuated cylinder, but merely a damper or shock absorber to prevent abrupt pivotal movements of shoe 35 relative to digging frame 11. Hence the main power lift cylinders 13a and 13b are continuously activated to control the digging angle of frame 11. The trench shoe 35 is free to assume an angular position relative to the digging frame 11 that is determined solely by the slope, if any, of the trench bottom which result from changes in the height of the rear chain sprocket axis.

Additionally, an upstanding mast 40 is provided which is rigidly mounted on a bracket 35h formed on the top end of the trailing shoe 35. Mast 40 is perpendicular to the bottom surface 35f of shoe 35. The important point, however, is that the mast mounting is located forwardly of the bottom shoe surface 35f. The mast 40 may be of the type described in my prior U.S. Pat. No. 3,825,808 and may incorporate a motor 43 for extending or contracting the vertical height of mast 40. At the top of mast 40, a laser beam sensor unit 44 is mounted comprising a plurality of vertically stacked cells (not shown) which generate electrical signals when impinged by a rotating laser beam L. The same circuitry as described in my prior U.S. Pat. No. 3,825,808 may be employed to respectively generate electrical signals when the center of the sensor unit 44 departs from a position of vertical alignment with the laser beam L. These signals are applied through conventional circuitry and control relays to operate the lift cylinders 13a and 13b which control the angular position of the digging frame 11 relative to vehicle 1. The cylinders 13a and 13b will be actuated in such a direction that the resulting movement of the frame 11 and of the shoe 35 tilts the mast 40 to bring the center of the sensor unit 44 back into vertical alignment with the laser beam L.

The operation of the described device to maintain the depth of the trench being dug at a pre-selected uniform level will now be described. The vertical distance from the center of the laser beam sensor unit 44 to the lowermost point of the path of the digging scoops 21 will be known when bottom surface 35f is horizontal. Similarly, the absolute elevation of the reference plane defined by the laser beam L will be known. It is therefore possible for the operator to adjust the effective height of the mast 40 by operating motor 43 so that the vertical separation of the center of the sensors 44 and the bottom shoe surface 35f corresponds to the desired depth of the trench relative to laser beam L. The operator, in beginning the trench, manually controls the primary actuating cylinders 13a and 13b to cause the trencher to enter the soil and dig to a depth where the center of the sensor unit 44 is in alignment with the reference plane defined by the laser beam L as shown by a suitable indicating light (not shown) provided on the vehicle. At this point, the operator switches the primary lifting cylinders 13a and 13b to a condition wherein they are controlled by the signals generated by the sensor unit 44 and continues the digging operation. If for any reason, such as the wheels of the vehicle encountering a ridge in the terrain, the trenching unit starts to dig a less shallow trench than desired, the bottom sprocket 14a, and hence the bottom of the trench would start to slope upwardly and accordingly, the front end of the trench shoe 35 would start to rise, but relative to the axis of sprocket 14a, shoe 35 is pivoting downwardly. Such movement, however, results in an upward displacement of the top of the mast 40 and hence the vertically stacked cells of the laser beam sensor unit 44 generates a signal resulting in the lift cylinders 13a and 13b being actuated to move the digging frame 11 downwardly and thus restore the depth of the trench to the desired level beneath the reference plane defined by laser beam L. The following movement of the trench shoe 35 moves the front end thereof and the mast 40 downwardly, restoring the sensor unit 44 to its neutral position relative to laser beam L.

Similarly, if the vehicle wheels encounter a depression, thus tending to make the depth of the trench go deeper, this change in trench depth produces a downward tilting of the mast 40 and the sensors 44. This would cause the laser beam L to strike the upper cells of the vertically stacked sensors 44 and result in a signal which would cause the lift cylinders 13a and 13b to lift digging frame 11 upwardly relative to the vehicle 1 and hence raise the bottom of the trench being dug back to the desired elevation with respect to the reference plane defined by the laser beam L.

Figure 3:
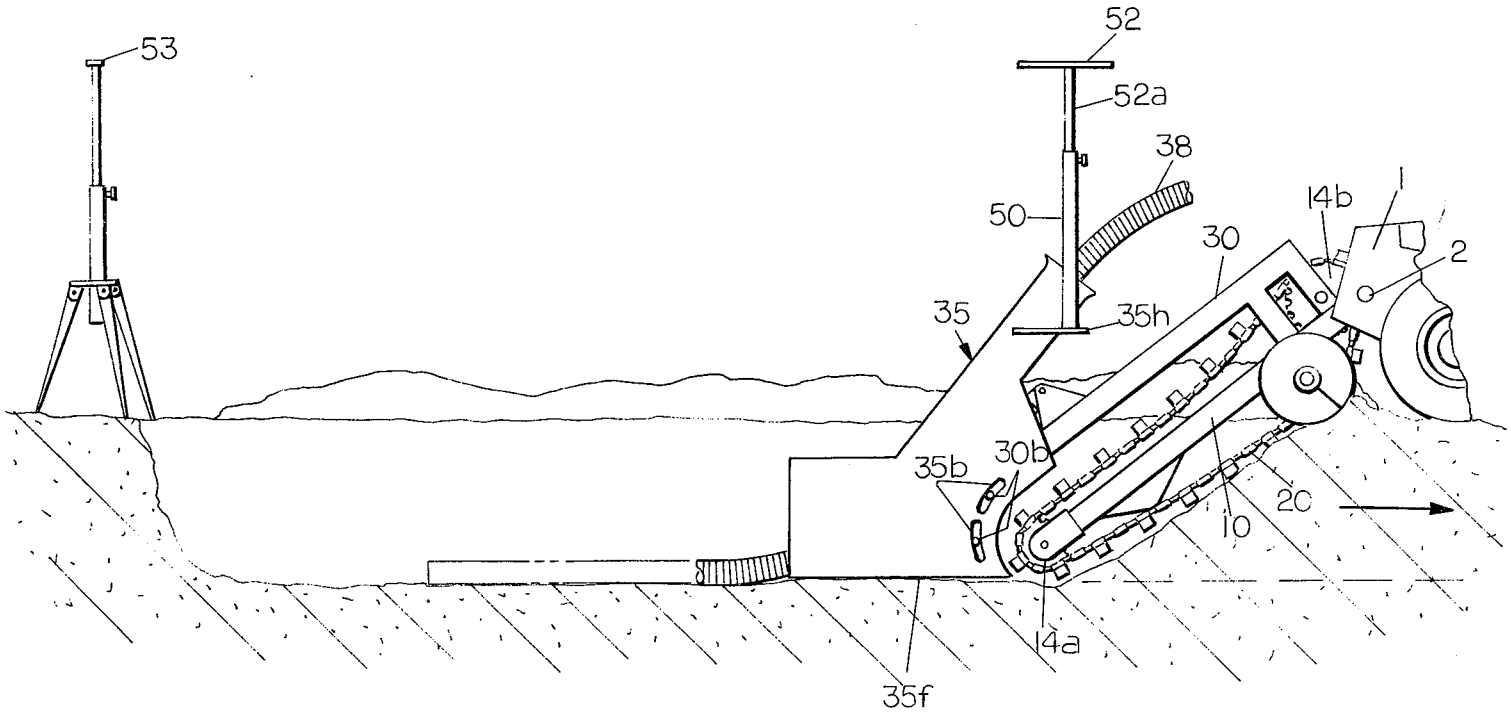
FIG. 3 is a view similar to FIG. 1 of a modification of this invention.

The principles of this invention may be applied to effect manual control of the depth of the trench being dug. Referring to FIG. 3, the same trenching apparatus is shown as heretofore described, with the exception that in place of the upstanding laser beam detecting mast 40, a hollow mast 50 is provided having its top portion slidably receiving the stem 52a of a horizontal sighting bar 52. A lock screw secures bar 52 in any selected position. As in the case of the previously described modification, the mast 50 is positioned forwardly of the ground engaging horizontal surface 35f of the shoe 35 so that the vertical movements of the mast 50, and hence the sighting bar 52, are opposite in direction to the tilting movements of the shoe 35 relative to the digging frame 11. Sighting bar 52 is located at approximately the eye level of the operator of the ditching machine.

Prior to initiation of the ditching operation, a plurality of adjustable height reference bars 53 are disposed along the line of the trench to be dug with the height of each reference bar being determined by conventional surveying techniques to correspond to the depth of the trench to be dug between the successive reference bars. Obviously, the first reference bar must be positioned rearwardly of the beginning of the trench to be dug.

In operation, the digging frame is forced into the ground by manual control of the primary lifting cylinders 13*a* and 13*b* until the desired trench depth is secured and the vehicle 1 moved forward to bring the bottom surface 35*f* of the floating shoe 35 into horizontal position, which means the mast 50 is vertical. Concurrently, the height of the sighting bar 52 is manually adjusted to bring the sighting bar 52 into line of sight coincidence with the first reference bar 53 and then locked in position by screw 51. As the trenching operation continues, the operator needs only to periodically sight along the sighting bar 52 and manually control the cylinders 13*a* and 13*b* to keep such bar in alignment with successive position bars 53, thus insuring that the trench depth being dug will correspond to the desired depth. Such manual system is more suitable for operations on relatively smooth terrain. Where the wheels or the track of the vehicle 1 encounters sharp ridges or depressions obviously, the re-action of the operator will not be sufficiently rapid to compensate for variations in trench depth produced by pitching of the vehicle 1 due to such obstructions or depressions and the laser beam control of FIG. 1 will be more effective.

Modifications of this invention will be apparent to those skilled in the art and it is intended to include all such modifications within the scope of the appended claims.

I claim:

1. In a trencher of the type having an endless chain carrying a plurality of digging scoops peripherally around an elongated digging frame, said digging frame having the forward end thereof pivotally mounted on a vehicle for movements in a vertical plane parallel to the path of travel of the vehicle, and means on the vehicle for driving said chain, the improvement comprising:

1. a sub-frame overlying said digging frame and having its front end rigidly secured to said digging frame;
2. a trench bottom shoe having an elongated bottom surface adapted to ride on the bottom of the newly dug trench, and means for pivotally mounting said shoe to the trailing end of said sub-frame for pivotal movements about a single horizontal axis provided on said digging frame, whereby said bottom surface is immediately tilted by variations in vertical position of said axis;
3. a cylinder for positioning said digging frame relative to said vehicle, thereby controlling the effective depth of the trench being dug;
4. means for establishing a reference plane at a known elevation;
5. an upstanding mast having its bottom end rigidly secured to said shoe at a point horizontally ahead of said bottom surface of said shoe, said mast being perpendicular to said bottom surface, whereby any upward or downward pivotal movement of said shoe relative to the digging frame produces a reverse tilting movement of the top of said mast relative to said reference plane, and
6. means on the top of said mast for determining the height of said mast relative to said reference plane, and
7. means for supplying fluid to said cylinder to maintain the top of said mast in a fixed vertical position with respect to said reference plane.

2. The apparatus defined in claim 1 wherein said means for establishing a reference plane comprises a horizontal bar mounted on an adjustable height vertical support rod, and said means on the top of said mast comprises a horizontal sighting bar.

3. The apparatus defined in claim 1 wherein said means for establishing a reference plane comprises an adjustable height, rotary laser beam and said means on the top of said mast comprises a vertical stack of laser beam sensors.

4. In a trencher of the type having an endless chain carrying a plurality of digging scoops peripherally around an elongated digging frame, said digging frame having the forward end thereof pivotally mounted on a vehicle for movements in a vertical plane parallel to the path of travel of the vehicle, the trailing end of said frame journaling a chain sprocket, and means on the vehicle for driving said chain, the improvement comprising:

1. a sub-frame overlying said digging frame and having its front end rigidly secured to said digging frame and its trailing end disposed in overlying relationship to the trailing end of said digging frame;
2. a trench bottom shoe having an elongated bottom surface adapted to ride on the bottom of the newly dug trench, and means for pivotally mounting said shoe to the trailing end of said subframe for pivotal movements solely about said sprocket axis, whereby said bottom surface is immediately tilted by variations in vertical position of said sprocket axis;
3. a cylinder for pivoting said digging frame relative to said vehicle, thereby determining the depth of the trench being dug;
4. an upstanding mast having its bottom end rigidly secured to said shoe at a point horizontally ahead of the bottom surface of said shoe, said mast being perpendicular to said elongated bottom surface, whereby any upward or downward pivotal movement of said shoe produced by variations in the height of said sprocket axis produces a reverse downward and upward tilting movement of the top of said mast with respect to the horizontal;
5. a horizontal sighting bar carried by the top of said mast, and
6. manual means for adjusting the height of said sighting bar whereby said operator may initially align said sighting bar with a fixed reference bar disposed along the path of travel of the trencher and thereafter effect manual adjustment of said cylinder to maintain the depth of the trench constant by maintaining said sighting bar in continuous visual alignment with said reference bar.

5. In a trencher of the type having an endless chain carrying a plurality of digging scoops peripherally around an elongated digging frame, said digging frame having the forward end thereof pivotally mounted on a vehicle for movements in a vertical plane parallel to the path of travel of the vehicle, the trailing end journaling a chain sprocket, and means on the vehicle for driving said chain, the improvement comprising:

1. means for periodically sweeping a laser beam over the working area where the trench is to be dug, said beam defining a reference plane of known height relative to the desired depth of the trench;
2. a sub-frame overlying said digging frame and having its front end rigidly secured to said digging frame;
3. a trench bottom shoe having an elongated bottom surface adapted to ride on the bottom of the newly dug trench, and means for pivotally mounting said shoe to the trailing end of said sub-frame for pivotal movement solely about said sprocket axis, whereby said bottom surface is immediately tilted by variations in vertical position of said sprocket axis;
4. a cylinder for positioning said digging frame relative to the vehicle, thereby determining the depth of the trench being dug;
5. an upstanding mast having its bottom end rigidly secured to said shoe at a point horizontally ahead of the bottom surface of said shoe, said mast being perpendicular to said elongated bottom surface, whereby any upward pivotal movement of said shoe relative to said sprocket axis produces a downward tilting movement of the top of said mast relative to said reference plane, and any downward pivotal movement of said shoe relative to said sprocket axis produces an upward tilting movement of the top of said mast relative to said reference plane;
6. laser beam sensors carried by the top portion of said mast; and
7. control circuits responsive to said sensors for operating said cylinder to vary the angular position of said digging frame to maintain the trench depth at said desired level below said laser beam reference plane.

6. In a trencher of the type having an endless chain carrying a plurality of digging scoops peripherally around an elongated digging frame, said digging frame having the forward end thereof pivotally mounted on a vehicle for movements in a vertical plane parallel to the path of travel of the vehicle, and the trailing end journaling a chain sprocket, and means on the vehicle for driving said chain, the improvement comprising:

1. means for periodically sweeping a laser beam over the working area where the trench is to be dug, said beam defining a reference plane of known height relative to the desired depth of the trench;
2. a sub-frame overlying said digging frame and having its front end rigidly secured to said digging frame; the trailing end of said sub-frame being arcuately curved in a radius concentric with the axis of said sprocket;
3. a trench bottom shoe defining an arcuate passage for slidably receiving said trailing end of said sub-frame, said shoe having an elongated bottom surface adapted to ride on the bottom of the newly dug trench, whereby changes in vertical position of said sprocket axis produce an immediate tilting of said shoe;
4. a cylinder for positioning said digging frame relative to said vehicle, thereby determining the depth of the trench being dug;
5. an upstanding mast having its bottom end rigidly secured to said shoe at a point horizontally ahead of and above said bottom surface of said shoe, said mast being perpendicular to said elongated bottom surface, whereby any upward or downward pivotal movement of said shoe relative to said sprocket axis produces a reverse tilting movement of the top of said mast relative to said reference plane;
6. laser beam sensors carried by the top portion of said mast; and
7. control circuits responsive to said sensors for operating said cylinders to vary the angular position of said digging frame to maintain the trench depth at said desired level below said laser beam reference plane.

* * * * *